US008820912B2

(12) United States Patent
Kanemoto

(10) Patent No.: US 8,820,912 B2
(45) Date of Patent: Sep. 2, 2014

(54) LIQUID DROPLET DISCHARGING DEVICE

(75) Inventor: Shuichi Kanemoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 213 days.

(21) Appl. No.: 13/369,565

(22) Filed: Feb. 9, 2012

(65) Prior Publication Data

US 2012/0212553 A1 Aug. 23, 2012

(30) Foreign Application Priority Data

Feb. 21, 2011 (JP) ..... 2011-034274
Feb. 2, 2012 (JP) ..... 2012-020752

(51) Int. Cl.

| | |
|---|---|
| ***B41J 2/01*** | (2006.01) |
| ***B41J 2/165*** | (2006.01) |
| ***B41J 3/28*** | (2006.01) |
| ***B41J 11/00*** | (2006.01) |

(52) U.S. Cl.
CPC . *B41J 3/28* (2013.01); *B41J 11/002* (2013.01)
USPC ..... 347/102; 347/29; 347/32; 347/108

(58) Field of Classification Search
None
See application file for complete search history.

(56) References Cited

U.S. PATENT DOCUMENTS

| | | | | |
|---|---|---|---|---|
| 7,665,823 | B2 * | 2/2010 | Yakura et al. | 347/33 |
| 7,753,482 | B2 * | 7/2010 | Ishida | 347/40 |
| 7,992,976 | B2 * | 8/2011 | Miura et al. | 347/85 |
| 2001/0003459 | A1 * | 6/2001 | Saijo | 347/32 |
| 2008/0204536 | A1 * | 8/2008 | Suzuki | 347/102 |
| 2009/0207223 | A1 * | 8/2009 | Cofler et al. | 347/102 |
| 2010/0128081 | A1 * | 5/2010 | Ito | 347/19 |
| 2010/0238245 | A1 * | 9/2010 | Ushiyama | 347/102 |

FOREIGN PATENT DOCUMENTS

| | | | |
|---|---|---|---|
| JP | 09191357 | A * | 7/1997 |
| JP | 11227176 | A * | 8/1999 |
| JP | 2000316217 | A * | 11/2000 |
| JP | 2004-188919 | A | 7/2004 |
| JP | 2005271582 | A * | 10/2005 |
| JP | 2007108497 | A * | 4/2007 |
| JP | 2009184231 | A * | 8/2009 |

* cited by examiner

*Primary Examiner* — Laura Martin
*Assistant Examiner* — Leonard S Liang
(74) *Attorney, Agent, or Firm* — Global IP Counselors, LLP

(57) ABSTRACT

A liquid droplet discharging device is provided with a discharge head capable of relative movement through a predetermined plane with respect to a substrate, and adapted to discharge liquid droplets cured by activation light; and an irradiation section for irradiating the liquid droplets on the substrate with the activation light. Also provided is a retaining device whereby a cover member that transmits the activation light is detachably retained in a direction parallel to the predetermined plane.

9 Claims, 9 Drawing Sheets

LIQUID DROPLET DISCHARGING DEVICE

CROSS-REFERENCES TO RELATED APPLICATIONS

The entire disclosure of Japanese Patent Application No. 2011-034274, filed Feb. 21, 2011 and 2012-020752, filed Feb. 2, 2012 are expressly incorporated by reference herein.

The present invention relates to a liquid droplet discharging device and a printing device.

In recent years, liquid droplet discharging devices that form an image or pattern on a recording medium using UV-curable ink, which cures upon irradiation with ultraviolet light, have been receiving attention. UV-curable ink, which dries extremely slowly until irradiated with ultraviolet light, at which point it rapidly cures, has properties favorable for use as printer inks. Because no solvent is evaporated when it cures, this type of ink also has the advantage of placing little burden upon on the environment.

UV-curable ink also demonstrates high bondability to a variety of recording media depending on vehicle composition. It also possesses many superior properties, such as chemical stability after curing, adhesiveness, chemical resistance, weather resistance, friction resistance, and the ability to withstand outdoor environments. For this reason, apart from thin, sheet-like recording media such as paper, resin film, metal foil, and the like, UV-curable ink can also form images on materials with surfaces having some degree of three-dimensionality, such as recording media labels, textile products, and the like.

With the aforedescribed liquid droplet discharging devices, there is a possibility that a mist generated during discharge of the liquid droplets will be deposited on the light source of the ultraviolet irradiation device and cure there, reducing the irradiated dose of ultraviolet.

Accordingly, in Unexamined Japanese Patent Application Publication No. 2004-188919 there is disclosed a configuration furnished with a cover member for covering the light source, and having an opening at the front in the direction of irradiation of ultraviolet; and a light-transmissive member detachably covering the opening of the cover member, and adapted to transmit light. With this configuration, illumination intensity can be assured simply by replacing the light-transmissive member, without having to replace the light source, thereby making it possible to reduce maintenance time.

SUMMARY

However, the prior art discussed above has problems such as the following.

With liquid droplet discharging devices of progressively smaller size, the gap between the liquid droplet discharge head and the recording medium, i.e., the gap between the ultraviolet irradiation device and the recording medium, is narrower. In Unexamined Japanese Patent Application Publication No. 2004-188919 there is not disclosed any specific structure for making the light-transmissive member detachable, nor any method of attachment and detachment thereof; however, attachment and detachment of the light-transmissive member would be difficult to accomplish in the case of a narrow gap.

With the foregoing in view, it is an object of the present invention to provide a liquid droplet discharging device whereby maintenance operations can be readily carried out, even in the case of a narrow gap.

In order to attain the aforedescribed object, the following configuration is adopted in the present invention.

The liquid droplet discharging device of the present invention is a liquid droplet discharging device provided with a discharge head capable of relative movement through a predetermined plane with respect to a substrate, and adapted to discharge liquid droplets cured by activation light; and an irradiation section for irradiating the liquid droplets on the substrate with the activation light; wherein the device is characterized by being provided with a retaining device whereby a cover member that transmits the activation light is detachably retained in a direction parallel to the predetermined plane.

Consequently, in the liquid droplet discharging device of the present invention, because mist produced during discharge of liquid droplets is deposited on the cover member positioned between the irradiation section and the substrate, reduced illumination intensity due to deposition of mist on the light source of the irradiation section can be prevented. Maintenance or replacement of the cover member can be carried out by attaching and detaching the cover member from the retaining device. During this time, the cover member can be attached and detached in a direction parallel to the direction of relative movement of the discharge head, and therefore there is no need for a large gap in a direction perpendicular to the direction of relative movement, i.e., the direction of opposition of the discharge head and the substrate. Therefore, according to the present invention, maintenance operations on the plate-shaped cover member can be carried out provided that there is a gap about equal to the thickness of the cover member, and maintenance operations can be readily carried out, even in the case of a narrow gap.

In the present invention, there is preferably adopted a configuration whereby the irradiation section has a housing having an opening that opens towards the side opposing the substrate, the housing adapted for housing the light source of the activation light; and the retaining device has a locking member attached to the housing so as to be moveable between a locked position at which the cover member is locked to the housing at a position at which the cover member blocks the opening, and a released position separated from the locked position in a direction orthogonal to the predetermined plane, at which the cover member is unlocked from the housing.

In so doing, according to the present invention, when the locking member is at the locked position, the cover member is locked at a position blocking the opening of the housing, thereby preventing mist from being deposited on the light source. When the locking member moves to the released position, the cover member is unlocked from the housing, and the cover member can be detached so that a maintenance operation can be carried out.

In the present invention, there is preferably adopted a configuration whereby the locking member is attached to the housing by a fastening member; and the direction of locking of the cover member to the housing is set to a different direction than the direction in which the locking member is fastened by the fastening member.

In so doing, according to the present invention, the force of fastening the locking member to the housing by the fastening member can be prevented from acting on the cover member. Therefore, according to the present invention, damage to the cover member can be avoided during attachment of the locking member to the housing.

There is preferably adopted a configuration whereby the fastening member is a grip section furnished to a perimeter of a head section.

In so doing, according to the present invention, by fastening or unfastening while gripping the grip section, it is possible for a maintenance operation to be carried out without employing a tool or the like, contributing to improved ease of operation.

In the present invention, there is preferably adopted a configuration whereby the locking member has a placement section on which the cover member is placed; and protruding sections provided at least to either side of the placement section in the direction of relative movement, so as to project beyond the placement section.

In so doing, according to the present invention, movement of the cover member is arrested through engagement with the protruding sections, even in cases in which force inducing movement in the direction of relative movement acts on the cover member placed on the placement section. Consequently, according to the present invention, the cover member can be prevented from becoming detached from the locking member by inertial force acting thereon during relative movement with respect to the substrate.

In the present invention, there is preferably adopted a configuration whereby the irradiation sections are disposed to either side of the discharge head, in the direction of relative movement.

In so doing, according to the present invention, regardless of whether the discharge head has moved towards one side or the other side in the direction of relative movement, the liquid droplets can be cured through irradiation with activation light from the irradiation section positioned to the back side on the direction of relative movement.

In the present invention, there is preferably adopted a configuration whereby the discharge head discharges the liquid droplets onto a semiconductor device furnished to the substrate.

In so doing, according to the present invention, printed patterns showing attribute information or the like for semiconductor devices can be formed as films or printed, at a predetermined level of print quality.

Herein, direction of relative movement and orthogonal direction are understood to encompass displacement caused by errors in manufacture or assembly.

DETAILED DESCRIPTION OF EXEMPLARY EMBODIMENTS

An embodiment of a printing method and printing device according to the present invention will be described below with reference to FIGS. 1 through 8.

The embodiment described below merely illustrates one aspect of the present invention; the present invention is not limited thereto, and various modifications within the technical scope of the invention may be made as desired. In the below drawings, the scale and measurements of the various structures are different from those used in actuality in order to aid understanding of the various configurations thereof.

Semiconductor Substrate

First, a semiconductor substrate will be described as an example of an object of drawing/printing using a printing device.

Figure 1A:
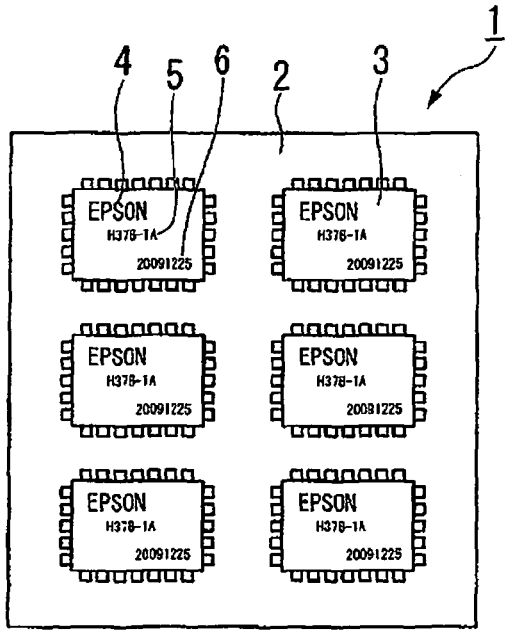
FIG. 1A is a simplified plan view of a semiconductor substrate, and 1B is a simplified plan view showing a liquid droplet discharging device.

FIG. 1A is a schematic overhead view of a semiconductor substrate. As illustrated in FIG. 1A, the semiconductor substrate 1 forming the substrate has a substrate 2. The substrate 2 need only be heat resistant and capable of allowing the semiconductor device 3 to be mounted thereupon, and a glass epoxy substrate, paper phenolic substrate, paper epoxy substrate, or the like can be used as the substrate 2.

A semiconductor device 3 is mounted upon the substrate 2. Markings such as a company logo 4, model code 5, manufacturing number 6, and the like are present upon the semiconductor device 3 as printed or otherwise delineated patterns. These markings are printed by a printing device described below.

Printing Device

Figure 1B:
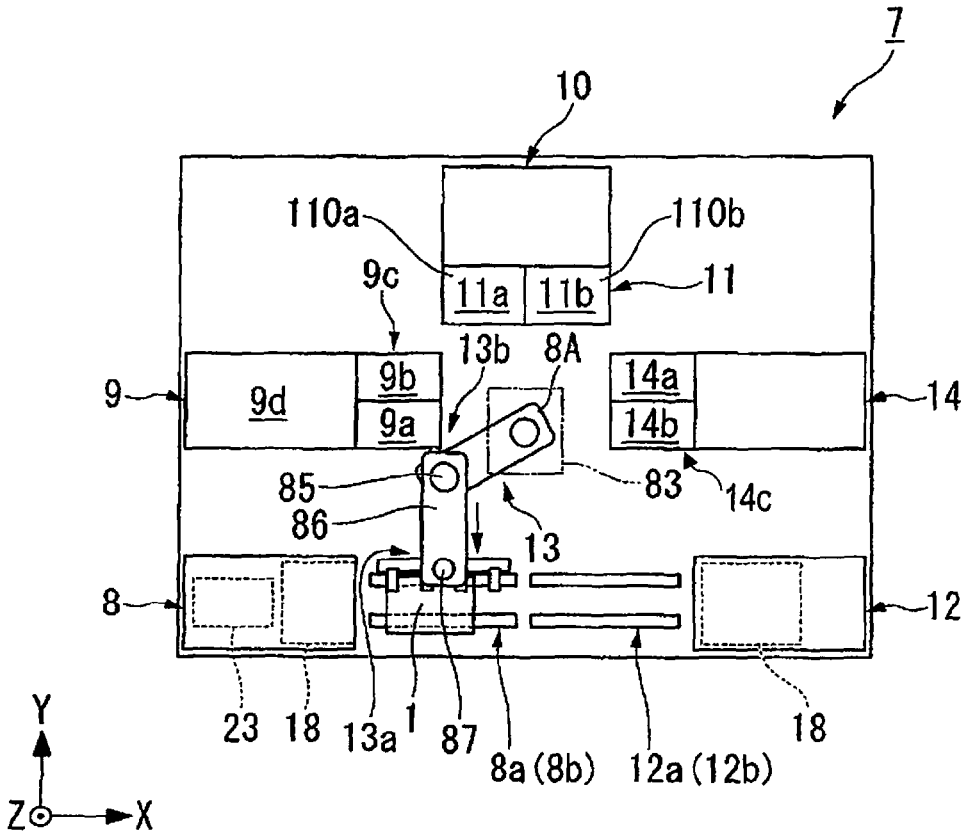

FIG. 1B is a schematic overhead view of a printing device.

As shown in FIG. 1B, the printing device 7 is constituted by a feeding part 8, preprocessing part 9, an application part (printing part) 10, a cooling part 11, a casing part 12, a transporter part 13, a post-processing part 14, and a controller part (not shown). The direction in which the feeding part 8 and casing part 12 are aligned, and the direction in which the preprocessing part 9, cooling part 11, and post-processing part 14 are aligned, will be referred to as the "X direction". The direction perpendicular to the X direction will be referred to as the "Y direction"; the application part 10, cooling part 11, and transporter part 13 are aligned in the Y direction. The vertical direction will be referred to as the "Z direction".

The feeding part 8 has a container containing a plurality of semiconductor substrates 1. The feeding part 8 has an intermediate position 8*a*, and the semiconductor substrates 1 are supplied from the container to the intermediate position 8*a*. The intermediate position 8*a* is provided with a pair of rails 8*b* extending in the X direction disposed at roughly the same height as the semiconductor substrates 1 dispensed from the container.

The preprocessing part 9 has a function of heating and modifying the surface of the semiconductor device 3. The preprocessing part 9 regulates the spreading of the liquid droplets discharged onto the semiconductor device 3 and the adhesiveness of the printed markings. The preprocessing part 9 has a first intermediate position 9*a* and a second intermediate position 9*b*, and takes in an unprocessed semiconductor substrate 1 from the first intermediate position 9*a* or the second intermediate position 9*b* and modifies the surface thereof. Afterward, the preprocessing part 9 transfers the processed semiconductor substrate 1 to the first intermediate position 9*a* or the second intermediate position 9*b*, and rests the semiconductor substrate 1 there. The first intermediate position 9*a* and second intermediate position 9*b* together form an intermediate position 9*c*. Processing position 9*d* is the position within the preprocessing part 9 wherein the preprocessing is performed.

The cooling part 11 is disposed at an intermediate position of the application part 10, and has the function of cooling the semiconductor substrate 1 after the same has been heated and surface-modified by the preprocessing part 9. The cooling part 11 has processing positions 11*a* and 11*b* that each retain and cool the semiconductor substrate 1.

The application part 10 has the function of discharging liquid droplets onto the semiconductor device 3 so as to mark out (print) a marking, and solidifying or curing the delineated marking. The application part 10 transfers the unprinted semiconductor substrate 1 from the intermediate position constituted by the cooling part 11 and performs marking and curing. Afterward, the application part 10 transfers the printed semiconductor substrate 1 to the cooling part 11 and rests the semiconductor substrate 1 there.

The post-processing part 14 performs post-processing by reheating the semiconductor substrate 1 positioned on the cooling part 11 after marking has been performed by the application part 10. The post-processing part 14 has a first intermediate position 14*a* and a second intermediate position 14*b*. The first intermediate position 14*a* and second intermediate position 14*b* collectively form an intermediate position 14*c*.

The casing part 12 has a container capable of containing a plurality of semiconductor substrates 1. The casing part 12 has an intermediate position 12*a*, and a semiconductor substrate 1 is transferred from the intermediate position 12*a* into the container. The intermediate position 12*a* is provided with a pair of rails 12*b* extending in the X direction disposed at roughly the same height as the container containing the semiconductor substrates 1. An operator transports the container containing the semiconductor substrates 1 out of the printing device 7.

A transporter part 13 is disposed in a central position of the printing device 7. The transporter part 13 has a scalar robot equipped with two arms 13*b*. A gripper 13*a* that grips the semiconductor substrate 1 in a cantilevered manner and supports it from its reverse side (undersurface) is provided on a tip of the arm 13*b*. The intermediate positions 8*a*, 9*c*, 11, 14*c*, and 12*a* are positioned within the range of movement of the gripper 13*a*. Thus, the gripper 13*a* is capable of transporting a semiconductor substrate 1 between the intermediate positions 8*a*, 9*c*, 11, 14*c*, and 12*a*. The controller part is a device for controlling the overall operation of the printing device 7, and supervises the operating status of each part of the printing device 7. The controller part also issues a command signal to the transporter part 13 to transport the semiconductor substrate 1. Thus, the semiconductor substrate 1 passes through each part in turn and is marked.

Below follows a description of the various parts of the printing device.

Feeding Part

Figure 2A:
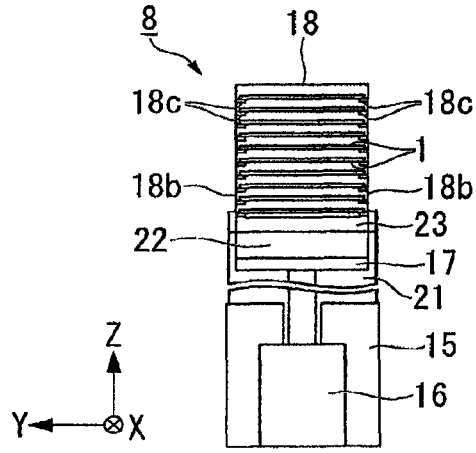
FIGS. 2A to 2C are simplified views showing a supply section.
Figure 2B:
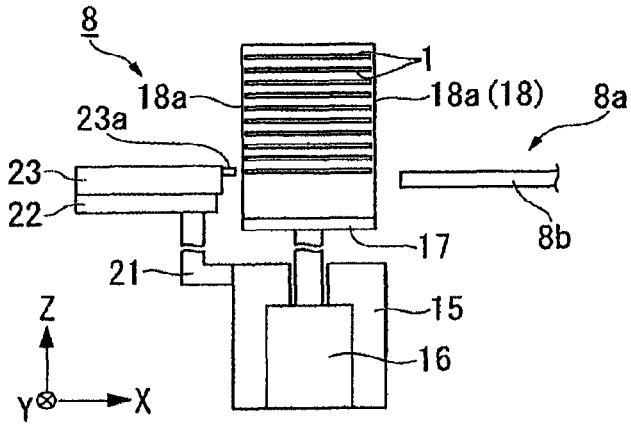
Figure 2C:
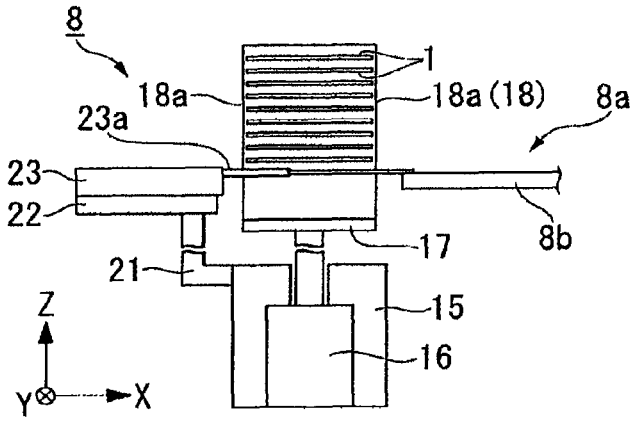

FIG. 2A is a schematic front view of a feeding part, and FIGS. 2B and 2C are schematic side views of a feeding part. As shown in FIGS. 2A and 2B, the feeding part 8 has a base 15. A lift device 16 is provided within the base 15. The lift device 16 has a direct action mechanism that operates in the Z direction. Mechanisms such as a ball screw/rotary motor combination, a hydraulic cylinder/oil pump combination, or the like may be used as the direct action mechanism. This embodiment employs a mechanism formed from, for example, a ball screw and a stepper motor. A lift platform 17 connected to the lift device 16 is provided on an upper side of the base 15. The lift platform 17 is configured so as to be able to ascend and descend only a predetermined distance by the lift device 16.

A cuboidal container 18 is provided above the lift platform 17, inside of which are contained a plurality of semiconductor substrates 1. An opening 18*a* is formed on both surfaces of the container 18 in the X direction, through which the semiconductor substrates 1 may enter and exit. Convex rails 18*c* are formed on the interiors of two side surfaces 18*b* on both sides of the container 18 in the Y direction, and the rails 18*c* extend in the X direction. The rails 18*c* are arrayed in a plurality of equidistant intervals in the Z direction. The semiconductor substrates 1 are inserted along the rails 18*c* in the X direction or the negative X direction and are stored arranged in the Z direction.

An ejector 23 is provided on a side of the base 15 in the X direction with a supporting member 21 and support platform 22 disposed therebetween. An ejector pin 23*a*, provided on the ejector 23 is thrust outward in the X direction by a direct action mechanism similar to that of the lift device 16 so as to push a semiconductor substrate 1 out toward the rails 8*b*. As such, the ejector pin 23*a* is disposed at roughly the same height as the rails 8*b*.

As illustrated in FIG. 2C, the ejector pin 23*a* of the ejector 23 projects in the positive X direction so that a semiconductor substrate 1 positioned slightly higher along the positive Z direction than the rails 18*c* is ejected from the container 18, moving onto and being supported by the rails 8*b*.

After the semiconductor substrate 1 has moved onto the rails 8*b*, the ejector pin 23*a* returns to a standby position as shown in FIG. 2B. Next, the lift device 16 lowers the container 18 so that the next semiconductor substrate 1 to be processed arrives at a height level with the ejector pin 23*a*. After this, the ejector pin 23*a* projects outward as described above to move the semiconductor substrate 1 onto the rails 8*b*.

Thus, the feeding part 8 moves the semiconductor substrates 1 in order from the container 18 onto the rails 8*b*. After all the semiconductor substrates 1 within the container 18 have been moved onto the rails 8*b*, an operator replaces the empty container 18 with another container 18 containing semiconductor substrates 1. Thus, semiconductor substrates 1 can be fed into the feeding part 8.

Preprocessing Part

The preprocessing part 9 performs preprocessing at processing position 9*d* upon the semiconductor substrates 1 conveyed to the intermediate positions 9*a* and 9*b*. Examples of such preprocessing include irradiation of the heated substrate with active light generated by a low-pressure mercury vapor lamp, hydrogen burner, excimer laser, plasma discharger, or the like. Using a mercury vapor lamp enables the hydrophobicity of the surface of the semiconductor substrate 1 to be modified by irradiating the semiconductor substrate 1 with ultraviolet light. Using a hydrogen burner enables the surface to be roughened by partially reducing the oxidized surface of the semiconductor substrate 1. Using an excimer laser enables the surface to be roughened by partially melting and solidifying the surface of the semiconductor substrate 1. Using a plasma or corona discharger enables surface roughening by mechanically abrading the surface of the semiconductor substrate 1. In this embodiment, a mercury vapor lamp is employed.

After preprocessing is complete, the preprocessing part 9 transfers the semiconductor substrate 1 to the intermediate position 9*c*. Next, the transporter part 13 removes the semiconductor substrate 1 from the intermediate position 9*c*.

Cooling Part

The cooling part 11 is provided with the processing positions 11*a* and 11*b*, and has cooling platforms 110*a* and 110*b* that are heat sinks or the like, the upper surfaces of which hold the semiconductor substrate 1 using suction.

The processing positions 11*a* and 11*b* (cooling platforms 110*a* and 110*b*) are positioned within the range of motion of the gripper 13*a*, and the cooling platforms 110*a* and 110*b* are exposed at the processing positions 11*a* and 11*b*. Thus, the transporter part 13 is capable of easily placing the semiconductor substrates 1 on the cooling platforms 110*a* and 110*b*. After the semiconductor substrate 1 has been cooled, the semiconductor substrate 1 is left resting on cooling platform 110*a* at processing position 11*a* or on cooling platform 110*a* at processing position 11*b*. Thus, the gripper 13*a* of the transporter part 13 is capable of easily gripping and transporting the semiconductor substrate 1.

Application Part

Next, the application part 10, which discharges liquid droplets onto a semiconductor substrate 1 to form markings, will be described with reference to FIGS. 3 through 6. A variety of devices for discharging liquid droplets are available, but a device using an inkjet method is preferred. An inkjet method allows microscopic liquid droplets to be formed, making it well suited to fine processing.

Figure 3A:
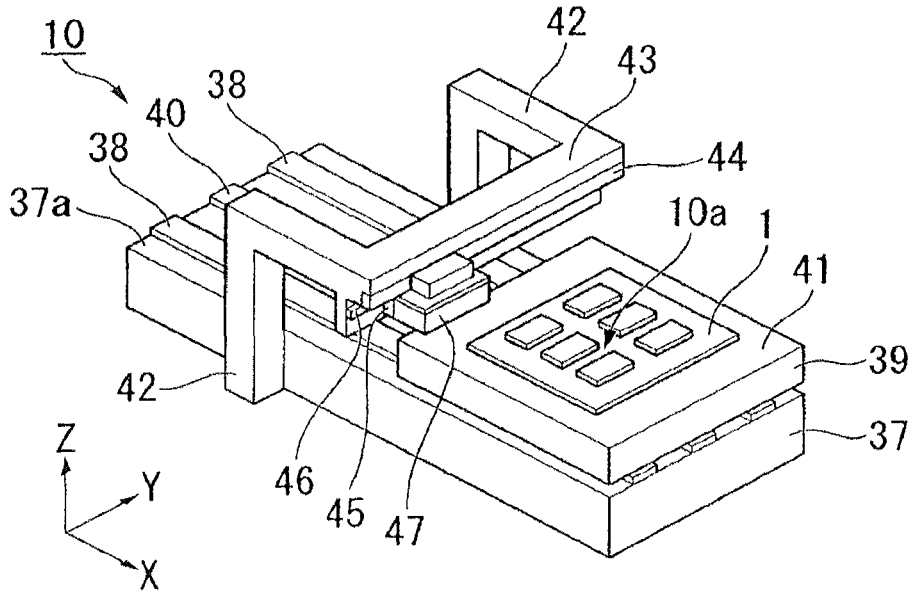
FIG. 3A is a schematic perspective view showing the configuration of an applicator section, and 3B is a simplified side view showing a carriage.

FIG. 3A is an outline perspective view of the configuration of an application part. Liquid droplets are discharged onto the semiconductor substrate 1 by the application part 10. As illustrated in FIG. 3A, the application part 10 has a cuboidal base 37. The direction in which the liquid droplet discharge head and the discharged material move relative to each other when liquid droplets are discharged is the primary scanning direction. The direction perpendicular to the primary scanning direction is the secondary scanning direction. The secondary scanning direction is the direction in which the liquid droplet discharge head and the discharged material move relative to each other when shifting lines. In this embodiment, the Y direction (second direction) is the primary scanning direction, and the X direction (first direction) is the secondary scanning direction.

A pair of guide rails 38 extending in the X direction is provided along the entire length of the X direction on an upper surface 37*a* of the base 37. A stage 39 having a direct action mechanism not shown in the drawings is attached to an upper side of the base 37 corresponding to the pair of guide rails 38. A linear motor, screw-type direct action mechanism, or the like may be used as the direct action mechanism of the stage 39. In this embodiment, for example, a linear motor is employed. The stage 39 is configured to travel and return at a predetermined speed along the X direction. The repetition of traveling and returning is referred to as scanning. A secondary scanning position detector 40 is further disposed on the upper surface 37*a* of the base 37 in parallel with the guide rails 38; this secondary scanning position detector 40 detects the position of the stage 39.

A rest surface 41 is formed on an upper surface of the stage 39, and the rest surface 41 is provided with a vacuum-type substrate chuck mechanism not shown in the drawings. After a semiconductor substrate 1 is placed upon the rest surface 41, the semiconductor substrate 1 is held in place on the rest surface 41 by the substrate chuck mechanism.

The position of the rest surface 41 when the stage 39 is positioned in, for example, the positive X direction is an intermediate position for a semiconductor substrate 1 loading or unloading position. The rest surface 41 is disposed so as to be exposed within the range of motion of the gripper 13*a*. Thus, the transporter part 13 is capable of easily placing a semiconductor substrate 1 on the rest surface 41. After the semiconductor substrate 1 has been coated (marking have been applied), the semiconductor substrate 1 rests upon the rest surface 41, which is an intermediate position. Thus, the gripper 13*a* of the transporter part 13 is capable of easily gripping and transporting a semiconductor substrate 1.

A pair of support platforms 42 is provided on both sides of the base 37 in the Y direction, and a guide member 43 extending in the Y direction is provided so as to bridge the pair of support platforms 42. A guide rail 44 extending in the Y direction is provided along the entirety of the X direction on the underside of the guide member 43. A carriage (moving means) 45 capable of moving along the guide rail 44 is formed in a roughly cuboidal shape. The carriage 45 has a direct action mechanism, and the direct action mechanism may be one similar to that of, for example, the stage 39. The carriage 45 scans in the Y direction. A primary scanning position detector 46 that measures the position of the carriage 45 is provided between the guide member 43 and the carriage 45. A head unit 47 is provided on the lower edge of the carriage 45, and a liquid droplet discharge head (not shown) is provided on the side of the head unit 47 towards the stage 39.

Figure 3B:
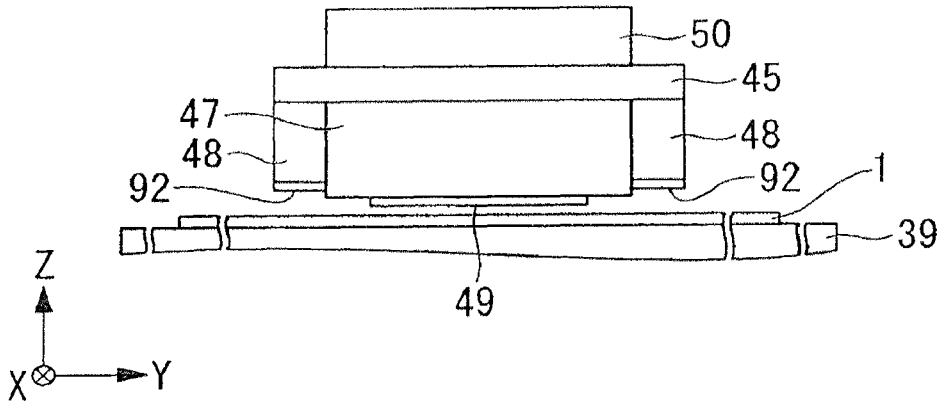

FIG. 3B is a simplified side view showing a carriage. As shown in FIG. 3B, on the side of the carriage 45 facing the semiconductor substrate 1, a head unit 47 and a pair of curing units 48 provided as irradiation sections are disposed at respectively equidistant spacing from the center of the carriage 45 in relation to the Y direction. A liquid droplet discharge head (discharge head) 49 for discharging liquid droplets protrudes from the side of the head unit 47 facing the semiconductor substrate 1.

A containment tank 50 is disposed to the upper side of the carriage 45 in the drawing, and the containment tank 50 contains a functional liquid. The liquid droplet discharge head 49 and the containment tank 50 are connected by a tube, not shown, and the functional liquid inside the containment tank 50 is supplied to the liquid droplet discharge head 49 via the tube.

The functional fluid contains a resin material, a photopolymerization initiator as a curing agent, and a vehicle or dispersion medium as primary components. A color agent such as a pigment or dye, a functional component such as a hydrophilic or hydrophobic resurfacing agent, or the like may be added to the primary components to obtain a functional fluid with unique functionality. In this embodiment, for example, a white pigment is added. The resin component of the functional fluid is for forming a resin layer. There is no particular limitation upon the resin component as long as it is liquid at room temperature and can be polymerized. Also, a resin component with low viscosity is preferable, as is one that is an oligomer. A monomer is especially preferable. The photopolymerization initiator acts upon a cross-linkable group of the polymer to effect a crosslinking reaction; an example of one such photopolymerization initiator is benzyl dimethyl ketal or the like. The vehicle or dispersion medium regulates the viscosity of the resin component. By adjusting the functional fluid to a viscosity such that it is easily discharged from the liquid droplet discharge head, it is possible for the liquid droplet discharge head to stably discharge functional fluid.

Figure 4A:
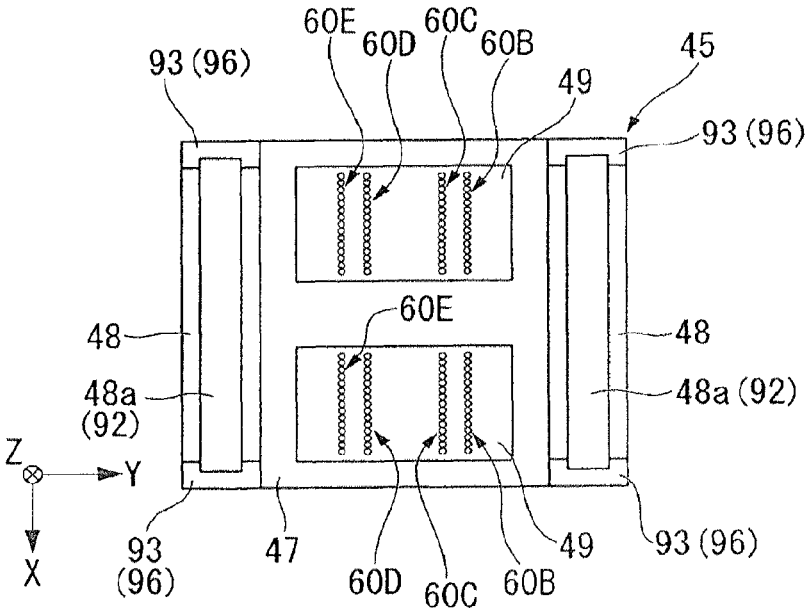
FIG. 4A is a simplified plan view showing a head unit, and 4B is a fragmentary simplified cross sectional view describing the structure of a liquid droplet discharge head.

FIG. 4A is a schematic overhead view of a head unit. As illustrated in FIG. 4A, two liquid droplet discharge heads 49 are disposed with an interval therebetween in the secondary scanning direction (X direction) on the head unit 47, and a nozzle plate 51 (see FIG. 4B) is disposed on the surface of each liquid droplet discharge head 49. A plurality of nozzles 52 are disposed in rows on each nozzle plate 51. In this embodiment, nozzle rows 60*b* through 60*e* of fifteen nozzles 52 are disposed arranged along the secondary scanning direction with gaps therebetween in the Y direction on each nozzle plate 51. The nozzle rows 60*b* through 60*e* disposed on the two liquid droplet discharge heads 49 are disposed along straight lines in the X direction. Nozzle rows 60*b* and 60*e* are disposed at equal distances from the center of the carriage 45 with respect to the Y direction. Likewise, nozzle rows 60*c* and 60*d* are disposed at equal distances from the center of the carriage 45 with respect to the Y direction. Thus, the distance between the curing units 48 and nozzle row 60*b* in the positive Y direction is equal to the distance between the curing units 48 and nozzle row 60*e* in the negative Y direction. Likewise, the distance between the curing units 48 and nozzle row 60*c* in the positive Y direction is equal to the distance between the curing units 48 and nozzle row 60*d* in the negative Y direction.

Figure 4B:
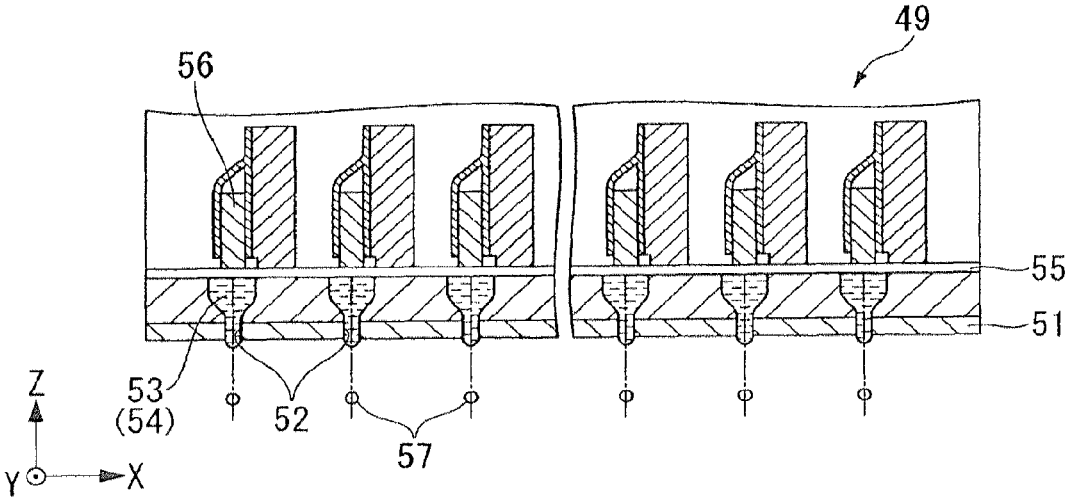

FIG. 4B is a schematic cross-section of the primary parts for describing the construction of a liquid droplet discharge head. As shown in FIG. 4B, the liquid droplet discharge head 49 has a nozzle plate 51, and a nozzle 52 is formed on the nozzle plate 51. A cavity 53 communicating with the nozzle 52 is formed on the upper side of the nozzle plate 51 in a position corresponding to the nozzle 52. Functional fluid (liquid) 54 is supplied to the cavity 53 of the liquid droplet discharge head 49.

A vibrational plate 55 that vibrates up and down, and expands and contracts the volume of the cavity 53, is provided on an upper side of the cavity 53. A piezoelectric element 56 that expands and contracts vertically and vibrates the vibrational plate 55 is disposed on an upper side of the vibrational plate 55 in a position corresponding to the cavity 53. The piezoelectric element 56 expands and contracts vertically, placing pressure on the vibrational plate 55 and causing it to vibrate, and the vibrational plate 55 expands and contracts the volume of the cavity 53, placing pressure upon the cavity 53. This causes the pressure within the cavity 53 to vary, and the functional fluid 54 within the cavity 53 to be discharged through the nozzle 52.

Figure 5A:
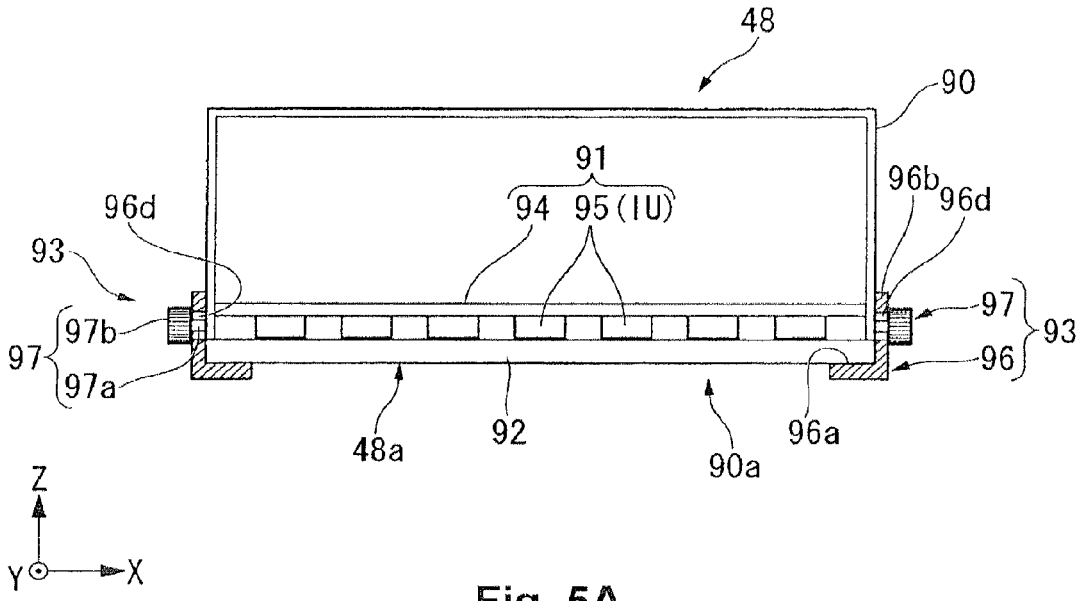
FIGS. 5A and 5B are cross sectional views of a curing unit 48 in the X direction.
Figure 5B:
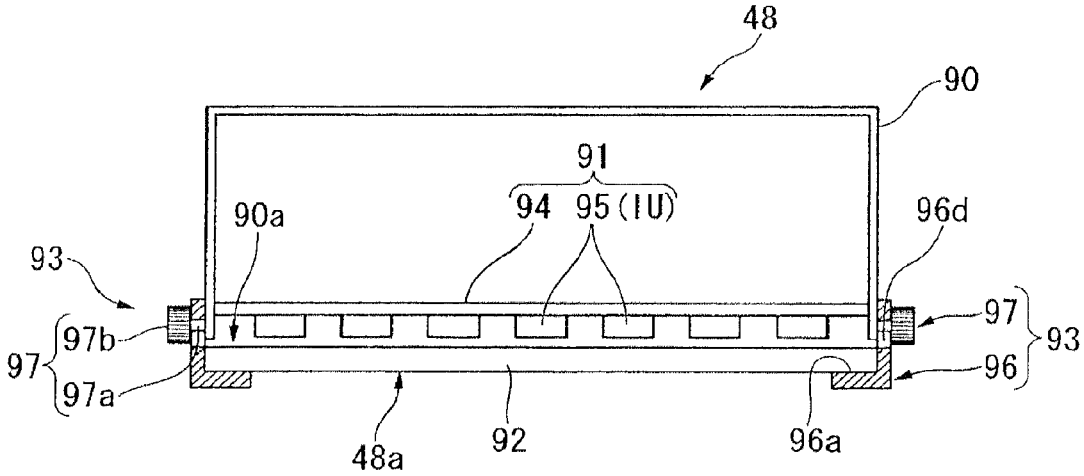

FIGS. 5A and 5B are cross sectional views of the curing units 48 in the X direction.

Each of the curing units 48 is provided with a housing 90 of generally rectangular solid shape furnished with an opening 90*a* on the −Z side (the stage 39 side) thereof, an irradiation device 91 housed within the housing 90, a cover member 92 disposed to the −Z side of the irradiation device 91, and a retaining devices 93 for retaining the cover member 92 in the XY plane; as shown in FIG. 3B and FIG. 4B, the units are disposed at positions to either side of the head unit 47 in the main scanning direction (direction of relative movement).

The irradiation device 91 is composed of an illumination unit IU, a heatsink 94, and the like. In the illumination unit IU, a plurality of light emitting diode (LED) elements 95 are disposed arrayed as light sources along the X direction. The LED elements 95 are elements adapted to receive supply of power, and to emit ultraviolet light, i.e., light beams of ultraviolet, in order to cure the discharged liquid droplets.

The cover member 92 is ultraviolet-transmissive and formed, for example, of quartz glass of rectangular panel shape, and functions as an irradiation port 48*a* to irradiate ultraviolet light towards the semiconductor substrate 1. The irradiation port 48*a* has an irradiation range of a length equal to or greater than the sum of the lengths of the discharge heads 49, 49, and the distance between the discharge heads 49, 49, in the Y direction. During printing, the cover member 92 is positioned between the stage 39 and the LED elements 95.

As shown in FIG. 5, the retaining devices 93 are furnished to the housing 90 at both ends thereof in the X direction, and are provided with a locking member 96 for retaining and releasably locking the cover member 92 to the housing 90, and a fastening member 97 for releasably attaching the locking member 96 to the housing 90.

Figure 6:
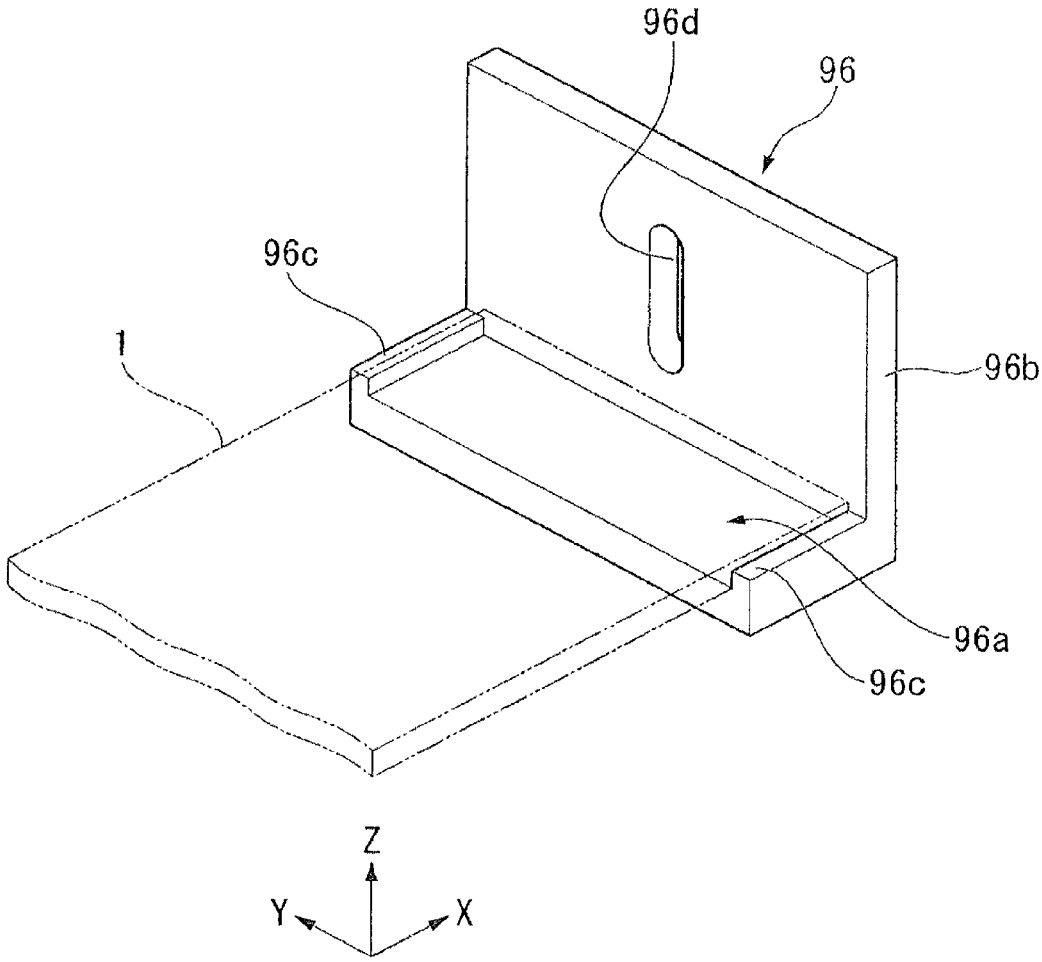
FIG. 6 is an exterior perspective view of a locking member 96.

FIG. 6 is an exterior perspective view of the locking member 96 positioned at the +X side.

The locking member 96 is formed with an "L" shape in front view, and has a placement section 96*a* of tabular form on which the cover member 92 is placed parallel to the XY plane, and an attachment section 96*b* projecting towards the +Z side from the edge at the +X side of the placement section 96*a*. To either side of the placement section 96*a* in the Y direction, there are furnished protruding sections 96*c* that project out towards the +Z side from the placement section 96*a*, at spacing greater than the width of the semiconductor substrate 1. The extent of projection of the protruding sections 96*c* beyond the placement section 96*a* is less than the thickness of the semiconductor substrate 1 placed on the placement section 96*a*. A through-hole 96*d* extending in the Z direction is formed in the center part of the attachment section 96*b* in the Y direction.

The fastening member 97 is composed of knobbed screw provided with a shaft section 97*a* passed through the through-hole 96*d* of the attachment section 96*b* and threadably mated to the housing 90, and a head section 97*b* having a grip portion formed by asperities on the perimeter thereof. By gripping and turning the head section 97*b* to thread the shaft section 97*a* into the housing 90 in the X direction which is the fastening direction, and engaging the head section 97*b* in the attachment section 96*b* of the locking member 96, the locking member 96 is fastened and locked to the housing 90. By gripping and turning the head section 97*b* in the opposite direction to separate the head section 97*b* from the attachment section 96*b* of the locking member 96, the locking member 96 is released from being fastened and locked to the housing 90.

During this time, at least in the Z direction, the locking members 96 are moveable by a distance equal to or greater than the amount of projection of the protruding sections 96*c* from the placement section 96*a*, between a locked position shown in FIG. 5A, at which the cover member 92 placed on the placement section 96*a* is locked to the housing 90 at a position blocking the opening 90*a* of the housing 90, and a released position shown in FIG. 5B, engaging the shaft section 97*a* at the +Z end of the through-hole 96*d* and separating towards the −Z side from the locked position (the stage 39 side, the direction away from the emission unit IU), to unlock the cover member 92 from the housing 90.

When the liquid droplet discharge head 49 receives a nozzle drive signal for driving the piezoelectric element 56, the piezoelectric element 56 expands, and the vibrational plate 55 decreases the volume of the cavity 53. As a result, an amount of the functional fluid 54 equal to the amount of volume decrease is discharged from the nozzle 52 of the liquid droplet discharge head 49 in the form of liquid droplets 57. After the functional fluid 54 has been applied thereto, the semiconductor substrate 1 is irradiated with ultraviolet light from the irradiation aperture 48*a*, so the functional fluid 54, which contains a curing agent, solidifies or cures.

Casing Part

Figure 7A:
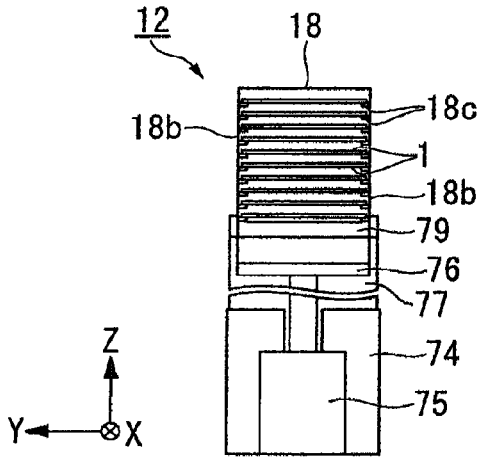
FIGS. 7A to 7C are simplified views showing a housing section.
Figure 7B:
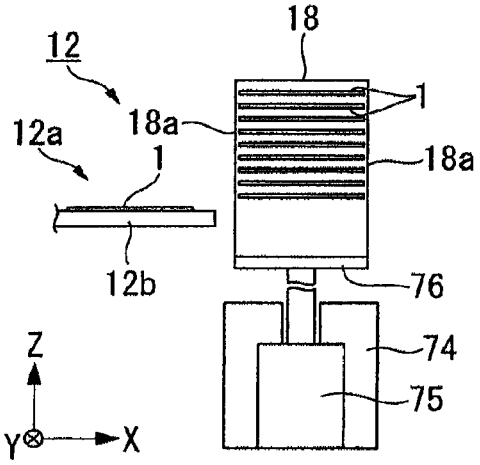
Figure 7C:
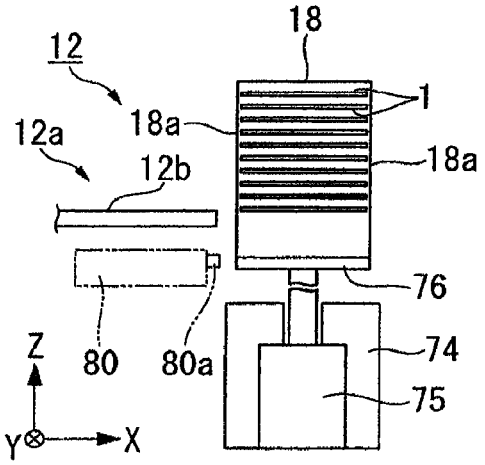

FIG. 7A is a schematic front view of a casing part, and FIGS. 7B and 7C are schematic side views of a casing part. As shown in FIGS. 7A and 7B, the casing part 12 has a base 74. A lift device 75 is provided within the base 74. A device similar to that used for the lift device 16 provided in the feeding part 8 can be used for the lift device 75. A lift platform 76 connected to the lift device 75 is provided on an upper side of the base 74. The lift platform 76 is raised and lowered by the lift device 75. A cuboidal container 18 is provided above the lift platform 76, inside of which is contained a semiconductor substrate 1. The container 18 is the same container 18 as provided in the feeding part 8.

A semiconductor substrate 1 placed on the intermediate position formed by the rails 12*b* by the transporter part 13 is carried from the rails 12*b* to the container 18 by the transporter part 13. Alternatively, a configuration such as that shown in FIG. 7C may be adopted wherein, for example, an ejector 80 having the same configuration as the ejector 23 above is provided underneath the rails 12*b* and positioned between the two rails 12*b*, 12*b* in the Y direction and is capable, by means of a lift device not shown in the drawings, of rising to a position level with the semiconductor substrate 1 after the semiconductor substrate 1 has been transported by the transporter part 13 from the rails 12*b* halfway to the container 18; and, when the transporter part 13 places the semiconductor substrate 1 on the rails 12*b*, the ejector 80 waits underneath the rails 12*b*, and, after the transporter part 13 has withdrawn from the rails 12*b*, the ejector 80 is raised to face the side of the semiconductor substrate 1, the semiconductor substrate 1 is moved into the container 18 by an ejector pin 23*a* that projects in the positive X direction.

After a predetermined number of semiconductor substrates 1 have been stored within the container 18 through repeatedly insertion of semiconductor substrates 1 into the container 18 and moving in the Z direction of the container 18 using the lift device 75 as described above, an operator replaces the container 18 filled with semiconductor substrates 1 with an empty container 18. Thus, an operator is able to collectively transport a plurality of semiconductor substrates 1 to the next process.

Transporter Part

Next, a transporter part 13 for transporting the semiconductor substrate 1 will be described with reference to FIGS. 1 and 8.

The transporter part 13 has a support 83 provided on a ceiling of the device interior, with a rotation mechanism formed from a motor, an angle detector, a decelerator, and the like provided within the support 83. An output shaft of the motor is connected to the decelerator, and an output shaft of the decelerator is connected to a first arm 84 disposed underneath the support 83. The angle detector is coupled to the output shaft of the motor, and the angle detector detects the angle of rotation of the output shaft of the motor. Thus, the rotation mechanism is capable of detecting the angle of rotation of the first arm 84, and rotating to a desired angle.

A rotation mechanism 85 is provided on the first arm 84 on an end opposite to the support 83. The rotation mechanism 85 is constituted by a motor, an angle detector, a decelerator, and the like, and has a function similar to that of the rotation mechanism provided in the support 83. An output shaft of the rotation mechanism 85 is connected to a second arm 86. Thus, the rotation mechanism 85 is capable of detecting the angle of rotation of the second arm 86, and rotating to a desired angle.

A lift device 87 is provided on the second arm 86 on an end opposite to the rotation mechanism 85. The lift device 87 has a direct action mechanism, and is capable of extending and retracting by driving the direct action mechanism. A mechanism similar to that of for example, the lift device 16 of the feeding part 8 may be used for the direct action mechanism.

Figure 8B:
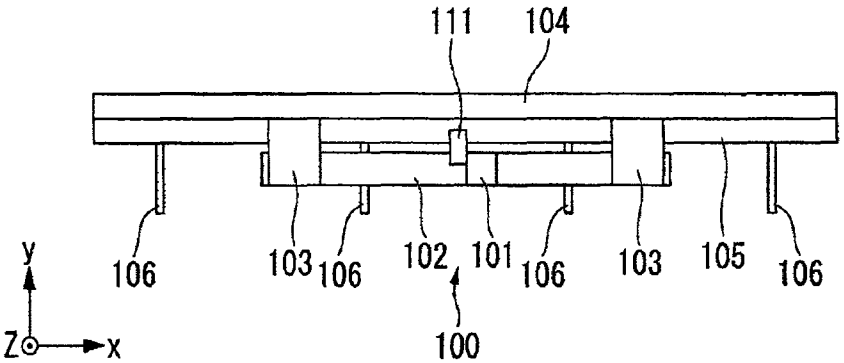
FIGS. 8A to 8C are diagrams showing the configuration of a conveying section.
Figure 8A:
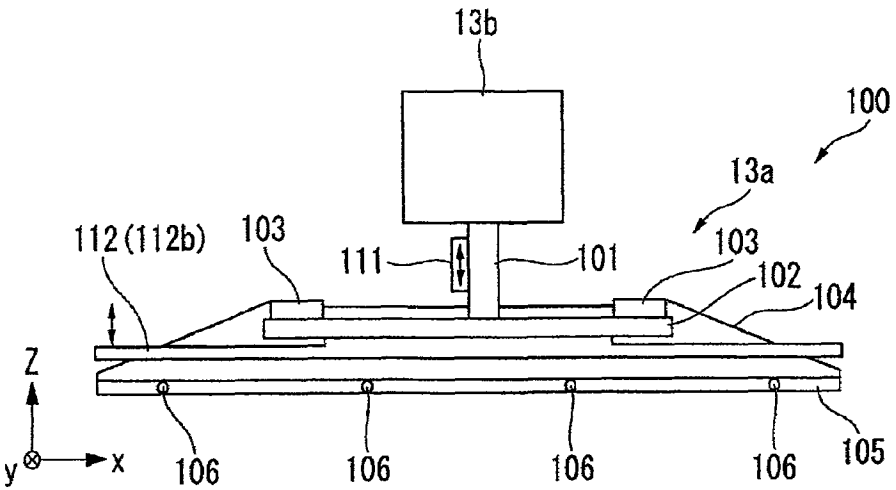
Figure 8C:
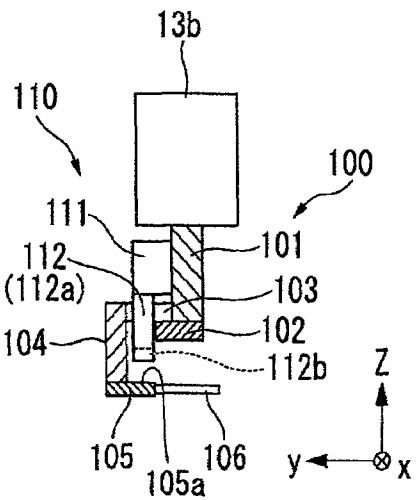

FIG. 8A is a frontal view of a gripper 13*a* disposed on a negative Z direction side of an arm 13*b*, FIG. 8B is an overhead view of the same (omitting the arm 13*b*), and FIG. 8C is a left side view of the same.

As the gripper 13*a* is provided so as to be rotatable in the θZ direction (the direction around the Z axis) with respect to the arm 13*b*, and its position in the XY plane varies, for convenience of description, one direction parallel with the XY plane will be referred to as the X direction, and a direction parallel with the XY plane and perpendicular to the X direction will be referred to as the Y direction (Z direction same for both).

The gripper 13*a* has a fixed part 100 rotatable in the θZ direction with respect to the arm 13*b* and used in a fixed state when a semiconductor substrate 1 is being gripped, and a moving part 110 freely movable in the Z direction with respect to the fixed part 100.

The primary elements constituting the fixed part 100 are a Z axis member 101, a suspension member 102, a linking member 103, a linkage plate 104, a grip plate 105, and a fork 106. The Z axis member 101 extends in the Z direction and is rotatable about the Z axis around the arm 13*b*. The suspension member 102 is formed as a strip extending in the X direction, and is fixed to a lower end of the Z axis member 101 in a central position along the X direction. The linkage plate 104 is disposed parallel to the suspension member 102 so as to leave a gap therebetween, and is linked with the suspension member 102 on both ends in the X direction by the linking member 103. The grip plate 105 is formed as a plate extending in the X direction, and, as shown in FIG. 8C, a positive Z direction surface thereof is fixed to the lower side of the linkage plate 104 on an edge thereof in the positive Y direction. Of the positive Z direction surface of the grip plate 105, a negative Y direction edge thereof acts as a gripping surface 105*a* when a semiconductor substrate 1 is being gripped.

The fork 106 supports from underneath the underside (negative Z direction surface) of the semiconductor substrate 1 gripped by the gripping surface 105*a*, and a plurality thereof (in this embodiment, four) extending in the Y direction from a negative Y direction side surface of the grip plate 105 are provided at intervals in the X direction. Even when the length of the semiconductor substrate 1 varies depending according to model, the spacing and number of the forks 106 are such that the substrate is supported at one location along the lengthwise direction, preferably at two locations.

The primary elements constituting the moving part 110 are an ascending/descending part 111 and a grip plate 112. The ascending/descending part 111 is constituted by an air cylinder mechanism or the like, and ascends and descends along the Z axis member 101. The grip plate 112 is capable of ascending and descending integrally with the ascending/descending part 111, is shorter than the gap in the x direction between the two linking members 103, 103, and has a width less than the gap between the suspension member 102 and the linkage plate 104; and is formed from an inserted part 112*a* inserted movably in the Z direction in the gap between the two linking members 103 and the gap between the suspension member 102 and the linkage plate 104, and a grip plate 112*b* formed integrally therewith positioned below the inserted part 112*a* and extending in the X direction for roughly the same length as the grip plate 105 underneath the suspension member 102.

The grip plate 112 constituted by the inserted part 112*a* and the grip plate 112*b* move integrally in the Z direction in response to the vertical motion of the ascending/descending part 111. When lowered, the grip plate 112 is capable, along with the grip plate 115, of gripping an end of the semiconductor substrate 1 therebetween; and when raised, the grip plate 112 releases the grip on the semiconductor substrate 1 by separating from the grip plate 115.

By inputting the data output by the detector provided on the transporter part 13 and detecting the position and disposition of the gripper 13*a*, and driving the rotation mechanism 85 so as to move the gripper 13*a* to a specific position, it is possible to transport the semiconductor substrate 1 being gripped by the gripper 13*a* to a specific processing part.

Printing Method

Figure 9:
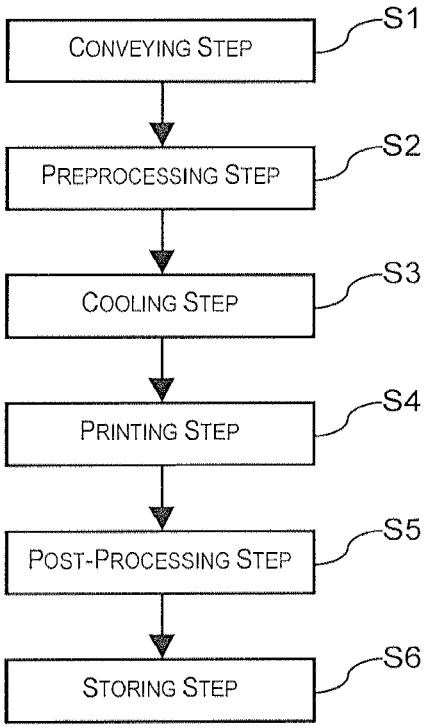
FIG. 9 is a flowchart showing a printing method.

Next, a printing method utilizing the above printing device 7 will be described with reference to FIG. 9. FIG. 9 is a flow chart illustrating a printing method.

As illustrated in the flow chart of FIG. 9, the printing method is primarily composed of an intake step S1 of taking in a semiconductor substrate 1 from a container 18, a preprocessing step S2 of performing preprocessing on the surface of the semiconductor substrate 1 that has been taken in, a cooling step S3 of cooling the semiconductor substrate 1 after being heated during the preceding preprocessing step S2, a printing step S4 of printing various markings on the cooled semiconductor substrate 1, a post-processing step S5 of performing post-processing on the semiconductor substrate 1 printed with the markings, and a storing step S6 of storing the semiconductor substrate 1 after post-processing has been performed within a container 18.

In the aforedescribed steps, the printing step S4 is a characterizing portion of the present invention, and therefore this characterizing portion will be described in the following description.

Prior to execution of the printing step S4, with the cover member 92 at a position parallel to the XY plane and blocking the opening 90*a* of the housing 90 as shown in FIG. 5A, the locking members 96 are locked to the housing 90 by the fastening members 97. At this time, whereas the locking direction of the cover member 92 to the housing 90 is the Z direction, the fastening direction of the fastening members 97, which is also the locking direction of the locking members 96 to the housing 90, is the X direction, and thus differs from the locking direction of the cover member 92, whereby the fastening force of the fastening members 97 has no adverse effect on the cover member 92.

The semiconductor substrate 1 upon which preprocessing was performed during the preprocessing step and upon which cooling was performed during the cooling step S3 is transported by the transporter part 13 to a stage 39 located at an intermediate position 10*a* of the application part 10. During printing step S4, the application part 10 actuates the chuck mechanism to hold the semiconductor substrate 1 resting on the stage 39 in place upon the stage 39. In the application part 10, liquid droplets 57 are discharged from a nozzle 52 in the nozzle rows formed on each liquid droplet discharge head 49 onto the semiconductor device 3 while the carriage 45 is made to scan (engage in relative movement) in, for example, the positive Y direction as an initial direction over the stage 39. During the return scan, liquid droplets 57 are discharged from a nozzle 52 in the nozzle rows formed on each liquid droplet discharge head 49 while the carriage 45 scans (engage in relative movement) in the negative Y direction over the stage 39.

In so doing, markings such as a corporate name marking 4, a model code 5, a manufacturing code 6, and the like are printed on the surfaces of the semiconductor devices 3. Then, during the aforedescribed outbound pass, the markings are irradiated with ultraviolet, via the cover member 92, by the curing unit 48 arranged at the −Y side of the carriage 45, which is the back side thereof in the scanning movement direction; whereas during the return pass, the markings are irradiated with ultraviolet, via the cover member 92, by the curing unit 48 arranged at the +Y side of the carriage 45, which is the back side thereof in the scanning movement direction. In so doing, because the functional liquid 54 forming the markings includes a photopolymerization initiator which begins to polymerize by ultraviolet, the surfaces of the markings solidify and cure.

During the aforedescribed scanning movement, because inertial force in the Y direction acts on the cover member 92 as well, there is a possibility of displacement of the cover member 92 with respect to the housing 90; however, because of the protruding sections 96*c* that project from both sides in the Y direction of the placement section 96*a* where the cover member 92 is placed, the cover member 92 is retained between the protruding sections 96*c*, which prevent displacement in position from occurring.

In the printing step S4, mist is produced during discharge of the liquid droplets 57, but because the LED elements 95 are housed inside the housing 90, and the opening 90*a* of the housing 90 is blocked by the cover member 92, the mist is prevented from being deposited on the LED elements 95 and curing there, reducing the illumination intensity.

During maintenance or replacement of the cover member 92 due to deposition of mist thereon or the like, firstly, the fastening members 97 are gripped by the head section 97*b* thereof, and rotated in the unfastening direction to release the locking members 96 from the state of being locked to the housing 90. At this time, the shaft sections 97*a* are threadably attached to the housing 90, without unthreading the shaft sections 97*a* from the housing 90. The unlocked locking members 96 are then moved from the locked position shown in FIG. 5A, towards the −Z side (the stage 39 side, the direction away from the emission unit IU) to the released position shown in FIG. 5B thereby moving the cover member 92 to the unlocked state separated from the housing 90.

In this state, after being moved to towards the +Z side (the emission unit IU side, the direction approaching the emission unit IU) by an extent of movement equal to or greater than the amount of projection of the protruding sections 96*c* from the placement section 96*a*, the cover member 92 is then moved past the protruding sections 96*c* in the Y direction parallel to the XY plane, so that the cover member 92 can be detached from the housing 90, specifically, from the curing unit 48. Then, in the reverse of the aforedescribed procedure, the cover member 92 having undergone maintenance such as a washing process or the like, or a replacement cover member 92, is moved in the Y direction parallel to the XY plane towards the placement section 96*a* of the locking members 96 at the released position, past the protruding sections 96*c* and positioned above the placement section 96*a*, and thereafter moved in the −Z direction (the stage 39 side, the direction away from the emission unit IU) and placed on the placement section 96*a*. The locking members 96 onto which the cover member 92 has been placed are then moved towards the +Z side, and the locking members 96 are then locked to the housing 90 by the fastening members 97 at a position with the opening 90*a* of the housing 90 blocked by the cover member 92, to thereby complete the installation of the cover member 92 onto the housing 90.

When printing of the semiconductor substrate 1 is complete, the application part 10 moves the stage 39 upon which the semiconductor substrate 1 to an unloading position. This enables the transporter part 13 to more easily grasp the semiconductor substrate 1. Then, the application part 10 stops actuating the chuck mechanism, releasing the grip on the semiconductor substrate 1.

Then, after post-processing is performed in the post-processing step S5, the semiconductor substrate 1 is transported by the transporter part 13 to the casing part 12 and stored within the container 18 in the storing step S6.

As described above, according to the present embodiment, because the opening 90*a* of the housing 90 that houses the emission unit IU is blocked by the cover member 92, a reduction in the amount of ultraviolet irradiation from the emission unit IU can be prevented, and reduced maintenance time of the emission unit IU can be achieved. Additionally, because the retaining devices 93 retain the cover member 92 in a detachable manner along the Y direction parallel to the XY plane, the gap necessary for detachable attachment of the cover member 92 depends on the thickness of the cover member 92, and maintenance operations can be readily carried out, even in the case of a narrow gap between the discharge head 47 and the semiconductor substrate 1, and a narrow gap between the curing units 48 and the semiconductor substrate 1.

Consequently, according to the present embodiment, printed patterns showing attribute information or the like for the semiconductor devices 3 can be formed as films with predetermined curing characteristics, and printing processes can be carried out with high efficiency on the semiconductor devices 3.

Additionally, according to the present embodiment, because the placement section 96*a* for placement of the cover member 92 is furnished with protruding sections 96*c* at both sides thereof in the direction of relative movement, the cover member 92 can be prevented from experiencing displacement of position due to inertial force acting on the cover member 92 during movement of the carriage 45, and sealing performance of the interior of the housing 90 can be maintained, making it possible to prevent infiltration thereof by mist.

Further, according to the present embodiment, because the direction of locking of the cover member 92 to the housing 90 (the Z direction) differs from the direction of fastening of the locking members 96 to the housing 90 (the X direction), fastening force can be prevented from being exerted on the cover member 92 during fastening and locking of the locking members 96 to the housing 90. Therefore, damage to the cover member 92 during attachment of the locking members 96 to the housing 90 can be prevented.

Further, according to the present embodiment, the head portion 97*b* of the fastening member 97 serves as a grip portion, and by fastening or unfastening while gripping the grip section, it is possible for a maintenance operation to be carried out without employing a tool or the like, thus contributing to improved ease of operation.

A favorable mode of embodying the present invention was described above with reference to the attached drawings, but it goes without saying that the present invention is not limited to this example. The shapes, assembly, and so forth of the various component parts described in the above example are but one example, and various modifications within the scope of the present invention can be made as design requirements dictate.

For example, whereas the aforedescribed embodiment showed an example of a configuration in which the cover member 92 is composed of quartz glass, there is no limitation thereto, and configurations formed of other materials are acceptable, provided that the materials transmit ultraviolet.

The configuration shown in the aforedescribed embodiment for the retaining devices 93 that detachably retain the cover member 92 in a direction parallel to the XY plane is but one example, and other configurations are possible.

For example, whereas the aforedescribed embodiment showed an example of a configuration in which the cover member 92 attached and detached by being moved in the Y direction parallel to the XY plane, there is no limitation thereto, and a configuration for attachment and detachment through movement in the X direction parallel to the XY plane is also acceptable.

In preferred practice, replacement of the cover member 92 is carried out at a position where there is no interference of the stage 39 and the carriage 45. In this case, for example, the stage 39 may be retracted to a position where no longer in opposition the carriage 45, in order to replace the cover member 92; or the carriage 45 may be retracted in the Z axis direction in order to replace the cover member 92. Alternatively, a maintenance space may be furnished at an end in the direction of movement of the carriage 45 (the Y direction), and the carriage 45 moved to the maintenance space in order to replace the cover member 92.

In a case in which a maintenance space is furnished, the maintenance space may be furnished with a cap unit, in a state with a space formed to either side thereof, for performing preparatory discharge (flushing) in a state with the liquid droplet discharge head (nozzles) blocked; and replacement of the cover member 92 may be performed within the space, with the liquid droplet discharge head (nozzles) blocked by the cap unit.

Further, the irradiation device 91 may be held at an angle with respect to the substrate, and irradiated with ultraviolet on the diagonal. In a case in which the cover member 92 must be inclined with respect to the horizontal direction, it must be able to be retained in by the locking members 96 in such a way as to not drop when released from the state of being fastened and locked by the fastening members 97.

Further, whereas in the aforedescribed embodiment, printing of the substrate takes place by scanning the carriage 45, a configuration whereby the carriage 45 is not scanned during printing, but instead the position of the substrate changes relative to the carriage 45, is also acceptable. In this case, the nozzle rows will have a line head configuration having length at least equal to the width of the substrate, so that the necessary printing can be accomplished simply by relative scanning of the carriage 45 and the substrate one time in one direction. During this time, the irradiation device 91, if disposed in proximity to the head unit 47 as well, will not need to be moved for scanning purposes, and therefore the cover member will not be detached by the action of inertia due to movement. In the case of a line head configuration as well, it is preferable for the irradiation device 91 to have an irradiation length about equal to, or greater than, the length of the nozzle rows, so that the entire discharge area can be covered.

In the above embodiment, a UV-curable ink was used as the UV-curable ink, but the present invention is not limited to this, and various active light-curable inks using visible light or infra-red light to cure can be used.

Likewise, a variety of active light sources emitting visible light or another type of active light, i.e., active light irradiators, may be used.

In the context of the present invention, there is no particular limit upon the "active light" so long as it is capable of imparting energy capable of generating initiating species in the ink via irradiation; and [the term] broadly includes alpha waves, gamma waves, X-rays, ultraviolet light, visible light, and electron beams. Of these, from considerations of curing sensitivity and ease of equipment procurement, ultraviolet light or an electron beam are preferable, and ultraviolet light is especially preferable. As such, it is preferable that the active light-curable ink be a UV-curable ink that cures upon irradiation with ultraviolet light, as in the case of this embodiment.

The invention claimed is:

1. A liquid droplet discharging device comprising:

a discharge head configured and arranged to undergo relative movement through a predetermined plane with respect to a substrate to discharge liquid droplets curable by activation light;

an irradiation section configured and arranged to irradiate the liquid droplets on the substrate with the activation light;

a housing configured and arranged to house light source of the activation light, the housing having an opening that opens towards a side opposing the substrate;

a cover member that transmits the activation light; and a retaining device whereby the cover member is detachably retained in a first direction parallel to the predetermined plane, the retaining device including a locking member on which the cover member is placed and a fastening member, the locking member having a hole extending a second direction crossing to the first direction, the fastening member being configured and arranged to pass through the hole to the housing such that the locking member is attached to the housing, and a position of the fastening member in the hole being changeable such that the lock member moves in the second direction relative to the housing.

2. The liquid droplet discharging device according to claim 1, wherein the locking member is attached to the housing so as to be moveable between a locked position at which the cover member is locked to the housing at a position at which the cover member blocks the opening, and a released position spaced apart from the locked position in the second direction at which the cover member is unlocked from the housing.

3. The liquid droplet discharging device according to claim 2, wherein a direction of locking of the cover member to the housing is set to a different direction than a direction in which the locking member is fastened by the fastening member.

4. The liquid droplet discharging device according to claim 3, wherein the fastening member includes a grip section furnished to a perimeter of a head section.

5. The liquid droplet discharging device according to claim 2, wherein the locking member has a placement section on which the cover member is placed, and protruding sections provided at least to both sides of the placement section in the direction of relative movement, so as to project beyond the placement section.

6. The liquid droplet discharging device according to claim 5, wherein the placement section has a surface portion facing the cover member, and the protruding sections project from the surface portion in the second direction.

7. The liquid droplet discharging device according to claim 6, wherein a length of the protruding sections in the second direction is smaller than a thickness of the cover member in the second direction.

8. The liquid droplet discharging device according to claim 1, wherein the irradiation section is disposed to both sides of the discharge head, in the direction of relative movement.

9. The liquid droplet discharging device according to claim 1, wherein the discharge head discharges the liquid droplets onto a semiconductor device furnished to the substrate.

* * * * *